US007188865B2

(12) United States Patent
Sugiyama et al.

(10) Patent No.: US 7,188,865 B2
(45) Date of Patent: Mar. 13, 2007

(54) COUNTERWEIGHT FOR HYDRAULIC SHOVEL

(75) Inventors: Kiyoshi Sugiyama, Kanazawa (JP); Junichi Ohmura, Komatsu (JP); Takenobu Andou, Kawagoe (JP)

(73) Assignee: Komatsu Ltd., Tokyo (JP)

( * ) Notice: Subject to any disclaimer, the term of this patent is extended or adjusted under 35 U.S.C. 154(b) by 415 days.

(21) Appl. No.: 10/789,157

(22) Filed: Feb. 27, 2004

(65) Prior Publication Data

US 2004/0188166 A1 Sep. 30, 2004

(30) Foreign Application Priority Data

Mar. 24, 2003 (JP) ..... 2003-079331

(51) Int. Cl.
*B60S 9/22* (2006.01)

(52) U.S. Cl. ..... 280/759

(58) Field of Classification Search ..... 280/759, 280/757

See application file for complete search history.

(56) References Cited

U.S. PATENT DOCUMENTS 3,567,049 A * 3/1971 Guinot ..... 414/694
3,687,484 A * 8/1972 Cosby ..... 280/755
5,671,820 A * 9/1997 Kobayashi et al. ..... 180/68.1
6,481,748 B1 * 11/2002 Okuda et al. ..... 280/755
6,922,925 B2 * 8/2005 Watanabe et al. ..... 37/466
2003/0226293 A1 * 12/2003 Takemura et al. ..... 37/466
2004/0172863 A1 * 9/2004 Otsuka et al. ..... 37/347

FOREIGN PATENT DOCUMENTS

EP 1413684 A1 4/2004
JP 08-068075 A 3/1996
JP 2000-309946 A 11/2000
JP 2001-106479 A 4/2001
JP 2001-279722 A 10/2001

* cited by examiner

*Primary Examiner*—Paul N. Dickson
*Assistant Examiner*—Timothy D. Wilhelm
(74) *Attorney, Agent, or Firm*—Frishauf, Holtz, Goodman & Chick, P.C.

(57) ABSTRACT

A counterweight for a hydraulic shovel, which is applicable to a compact to large-sized hydraulic shovels, and is capable of realizing favorable engine maintainability and assurance of sufficient mass, is provided. For this purpose, supporting column portions (12*b*, 12*c*) are vertically provided at left and right of a counterweight (12). The left and right supporting column portions are constituted as an increase amount of mass of the counterweight. At least one of a floor frame (30), a canopy (40), outer casings (14, 16) and engine partition walls (33*a*, 33*b*) is supported at the left and right supporting column portions. Further, an engine (13) is placed at a position fronting to between the left and right supporting column portions.

7 Claims, 7 Drawing Sheets

COUNTERWEIGHT FOR HYDRAULIC SHOVEL

TECHNICAL FIELD

The present invention relates to a counterweight for a hydraulic shovel.

BACKGROUND ART

In a hydraulic shovel, a working machine is provided at a front part of an upper revolving superstructure, a counterweight is placed at a rear end portion of the upper revolving superstructure and a heavy-mass engine is placed in the vicinity of a front of the counterweight in order to be balanced with the working machine, and a cab seat is placed in front of the engine, in general. In order to simplify the explanation, the term, cab seat, is assumed to be a generic name of an occupied range of an operator, which includes a seat, a foot floor part which is in front of the seat for the operator to place his or her feet on, and an operating device having an operating lever and the like. When only the seat is to be indicated, it is distinguished from the cab seat by calling it as an operator seat. The same shall apply hereinafter.

According to the above-described constitution, there arises the problem that maintainability of the engine and its peripheral equipment is inhibited because a rear surface side of the engine is closed by the counterweight, and various kinds of means are conventionally considered to solve this problem. First, as a first prior art example, a structure, in which each part of a counterweight facing each of maintenance target parts of an engine, a main pump, a radiator and the like is constituted of a split counterweight attachable and detachable, and a maintenance operation can be performed from the ground by removing a corresponding split counterweight for each maintenance target part by a crane, is known (for example, pages 4 to 5, and FIG. 1 of Japanese Patent Laid-open No. 2001-106479).

As a second prior art example, a structure in which windows are provided at a center of a rear surface and a left and right side surfaces of the counterweight, maintenance inspection for the engine and the like is performed through the three windows, each window cover attached to the three windows has a rib plate with springiness on a back surface, and is fixed by engaging the rib plate in a groove of an inner perimeter of each window to make attachment and detachment easy, is known (for example, pages 2 to 3, and FIG. 2 of Japanese Patent Laid-open No. 2001-279722).

However, in the first prior art example, an operation of removing the split counterweight at the region facing the maintenance target part is required when the maintenance operation is performed. Further, a crane is required for detachment and attachment of the split counterweight, and the construction of connecting portions at the spots where the counterweight is split causes high cost, thereby causing the problem of making it difficult to apply the first prior art example to the counterweight of a compact hydraulic shovel operated in, for example, an urban area. In the second prior art example, the counterweight needs to be so large as the other parts can make up for large mass loss caused by opening the window portions because three windows as wide as to make the maintenance easy are provided on the counterweight, and therefore there is the problem that it is difficult to apply the second prior art example to the counterweight of a compact hydraulic shovel.

For the reason as described above, in a conventional compact hydraulic shovel, the height of the counterweight is generally restrained, an inspection cover is placed adjacently to an area above the counterweight to be openable and closable, and the engine is maintained from a position diagonally above over the counterweight by opening this inspection cover.

According to FIG. 5 to FIG. 7, a third prior art example of a counterweight according to the prior art will be explained with a rear end small revolving hydraulic shovel having a small revolving radius of an rear end being cited as an example of a compact hydraulic shovel. A hydraulic shovel 2 is loaded with an upper revolving superstructure 50 rotatably on a top portion of a base carrier 3. A locus of a revolving radius R of a rear end portion of the upper revolving superstructure 50 is structured to be within a lateral external width B of the base carrier 3.

The upper revolving superstructure 50 has a revolving frame 51 at a bottom portion. A working machine 5 is mounted at a front portion of the revolving frame 51 to be swingable up and down via a swing bracket 4 which is made laterally swingable by a swing cylinder 4*a*. For the purpose of keeping balance with the working machine 5, a counterweight 52 is placed at a rear end portion and an engine 13 is placed in the vicinity of a front of the counterweight 52, in a rear portion of the revolving frame 51. In order to make it possible to perform daily inspection and maintenance of the engine 13, a height H1 of the counterweight 52 is restrained, and an inspection cover 57 is mounted on a top portion of the counterweight 52 to be openable and closable in an up and down direction as shown by the chain double-dashed line in FIGS. 5 and 6.

A frame 53 is vertically provided at a top portion of the revolving frame 51, in the vicinity of the engine 13. A side surface partition wall 54, a top surface partition wall 55 and a front surface partition wall 56 for the engine 13 are respectively mounted to the frame 53. A cab seat 60 constituted of an operator seat 21, a floor frame 61 for supporting the operator sheet 21, and an operating lever 22 placed at a front portion of the floor frame 61 is provided in front of the front surface partition wall 56. An equipment room 58 is placed adjacently to a right side of the cab seat 60, and a fuel tank, a working fluid tank, a main operating valve and the like (none of them are shown) are placed in the equipment room 58. The compact upper revolving superstructure 50 is constituted of them.

However, in the third prior art example, there arise a few problems as a result of constituting the upper revolving superstructure 50 including the counterweight 52 to be compact though the working machine 5 protrudes forward to be long.

As a first problem, it is difficult to give sufficient allowance to the mass of the counterweight 52 as a result of restraining the height H1 of the counterweight 52. For this reason, when the equipment specification of the hydraulic shovel 2 is replaced corresponding to an operation site, for example, a bucket 6 at the tip end portion of the working machine 5 is replaced with an attachment of a different specification and the like, the frequency at which mounting of an additional counterweight 52A (shown by the chain double-dashed line in the drawing) is needed becomes high. On such an occasion, there is the possibility that a revolving radius RA of the rear end portion of the upper revolving superstructure 50 exceeds a lateral external width B of the base carrier 3. As a result, there arises the problem that the frequency, at which extra cost, complicated parts management and reduction in function occur, becomes high.

As a second problem, though the height H1 of the counterweight 52 is restrained, a lower rear surface side of the engine 13 is closed by the counterweight 52. Consequently, when, for example, a starter 13*s* of the engine 13, a compressor 13*k* when the air conditioner is loaded, and the like are mounted to the rear surface side (vehicle body rear portion side) of the engine 13, the counterweight 52 interferes with the maintenance operation of them and becomes the operation in the narrow space. As a result, there arises the problem that the maintainability of the engine 13 is not secured sufficiently.

SUMMARY OF THE INVENTION

The present invention is made in view of the above-described problems, and has its object to provide a counterweight for a hydraulic shovel which is universally applicable to counterweights of a compact to large-sized hydraulic shovels, and is capable of realizing favorable engine maintainability and assurance of sufficient mass.

In order to attain the above-described object, in the counterweight for a hydraulic shovel according to the present invention, supporting column portions are vertically provided at left and right of the counterweight.

According to the above constitution, it becomes possible to utilize the counterweight, which is conventionally used simply as the heavy load, as the structural component. For example, the left and right supporting column portions of the counterweight also serve as the conventional structural component for supporting the outer casing members and the like, whereby the space for the conventional structural component can be utilized as the space for the counterweight. As a result, the structure around the counterweight can be simplified.

In the counterweight for the hydraulic shovel, the left and right supporting column portions are constituted as an increase amount of mass of the counterweight. According to this constitution, the mass of the counterweight can be increased by positively utilizing the mass of the left and right supporting column portions as the increase amount of the mass of the counterweight. Accordingly, the mass of the counterweight can be freely distributed among the base portion (main body) and the supporting column portions. For example, the opening area fronting to the engine can be made larger by making the left and right supporting column portions thicker, and the height dimension of the base portion (main body) smaller, and therefore maintainability can be remarkably improved when the engine is maintained from the rear side of the engine over the counterweight.

In the counterweight for the hydraulic shovel, a floor frame may be supported at the left and right supporting column portions. According to this constitution, the floor frame is firmly supported, and therefore it becomes possible to load the canopy or the cabin directly on the floor frame, for example, and therefore it becomes unnecessary to provide the other rigid frames and the like on the revolving frame. As a result, the degree of freedom of the placement space for the counterweight is increased, and it becomes possible to secure the sufficient mass of the counterweight easily. Accordingly, the upper revolving superstructure has the extremely simple structure, and the assembling man hours and the number of components can be sharply reduced.

In the counterweight for the hydraulic shovel, at least any one of a canopy, outer casings and engine partition walls may be supported at the left and right supporting column portions. According to this constitution, by attaching the counterweight at the rear end portion of the revolving frame, at least one of the canopy, the outer casings, and the engine partition walls can be supported by the left and right supporting column portions without providing the other frame members vertically. This makes it possible to simplify the mounting structure around the counterweight extremely and reduce the number of components and assembling man hours sharply.

In the counterweight for the hydraulic shovel, an engine may be placed at a position fronting to between the left and right supporting column portions. According to this constitution, for example, when the engine is placed at the position fronting to between the left and right supporting column portions, in front of the counterweight, it becomes possible to maintain the substantially entire engine from between the left and right supporting column portions over the counterweight. This can remarkably improve the maintainability of the engine.

In the counterweight for the hydraulic shovel, opening and closing support points of the outer casings may be provided on at least any one of the left and right supporting portions. According to this constitution, the outer casings can be simply attached to the left and right supporting column portions to be openable and closable without using the other frame members and the like. In addition, the opening area is not decreased following the placement of the other frame members and the like, and therefore maintainability of the engine can be remarkably improved.

BEST MODE FOR CARRYING OUT THE INVENTION

Figure 1:
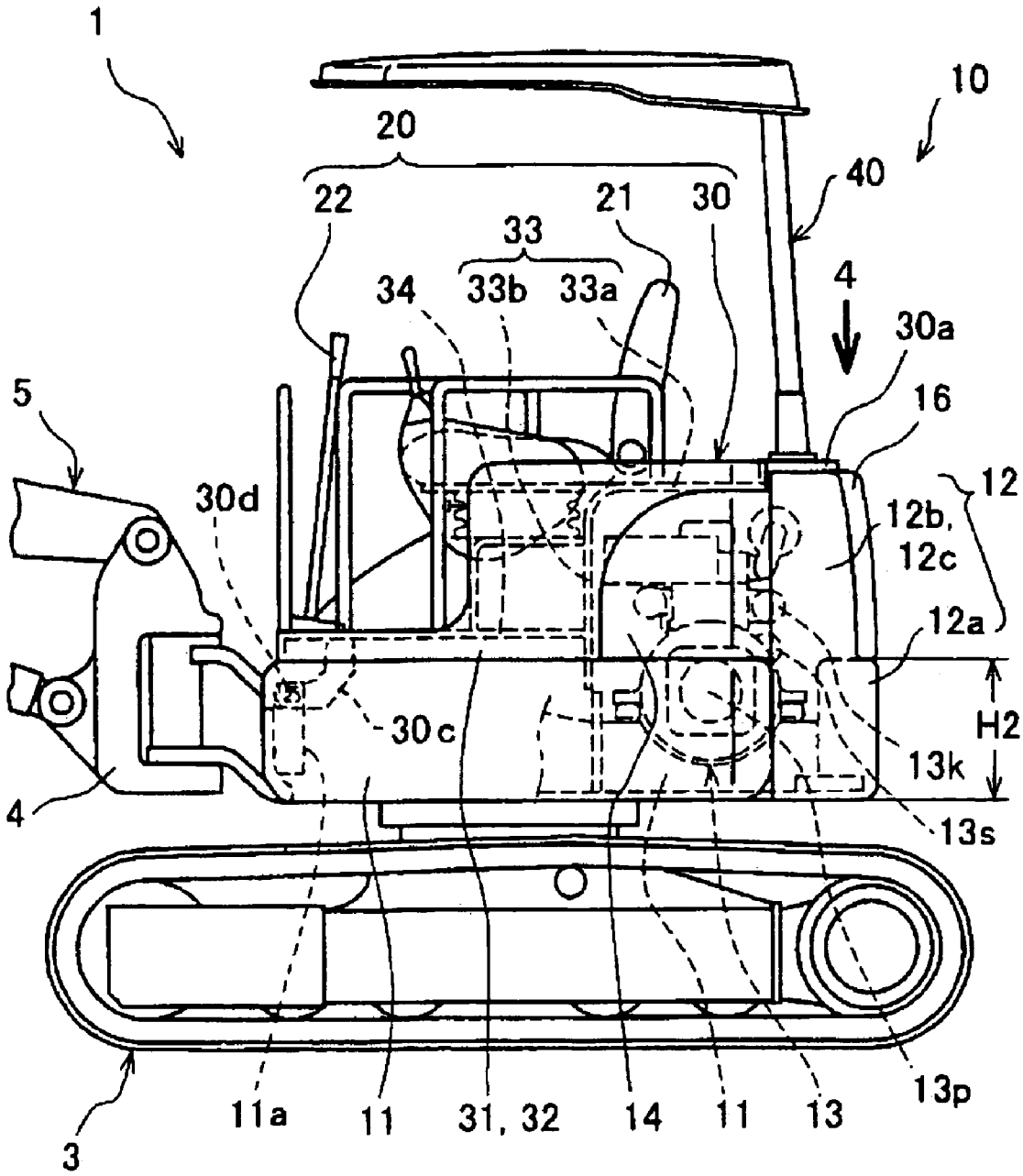
FIG. 1 is a side view of an essential part of a hydraulic shovel to which a counterweight according to the present invention is applied.
Figure 2:
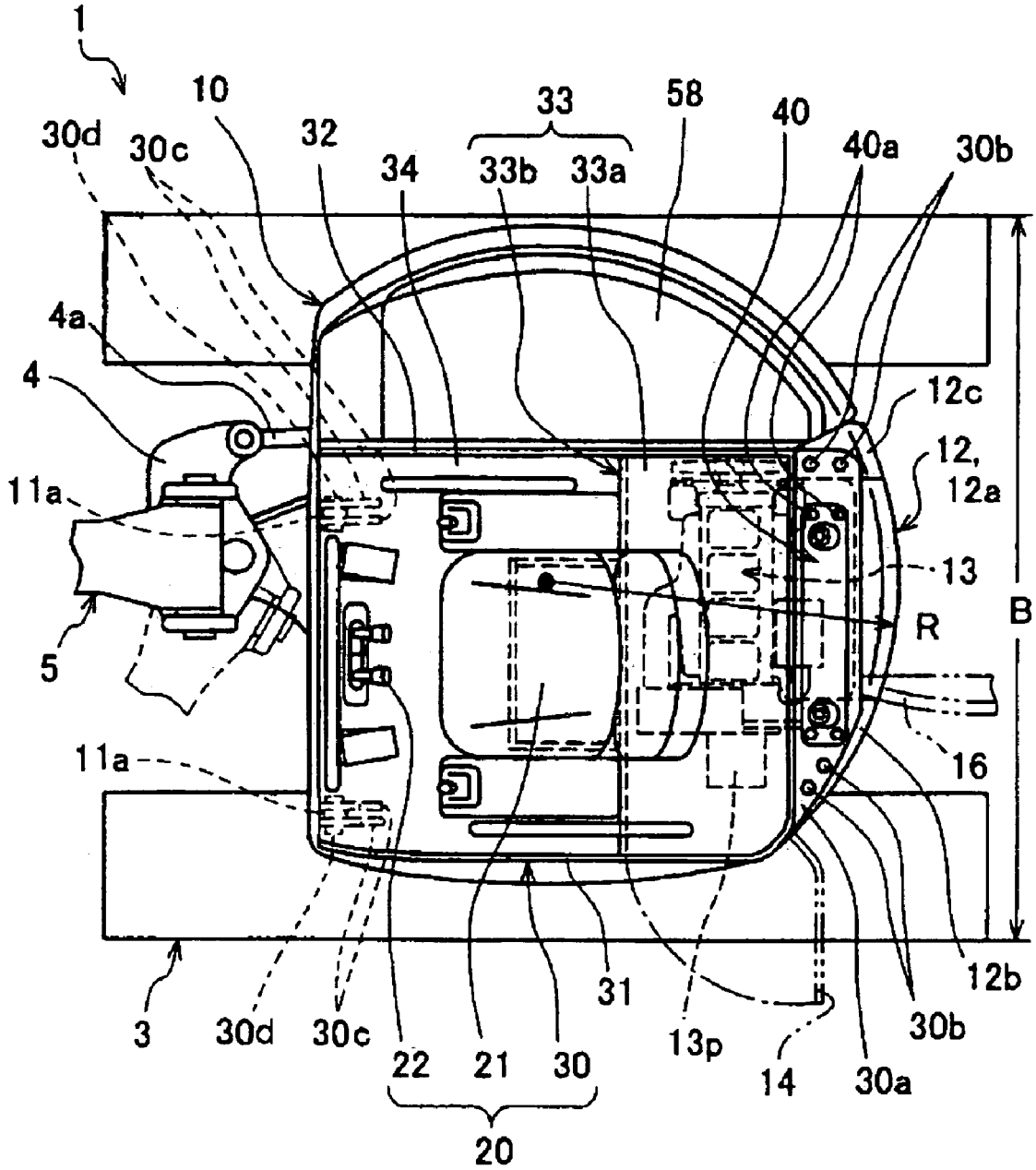
FIG. 2 is a top view of the essential part of the hydraulic shovel in FIG. 1.
Figure 3:
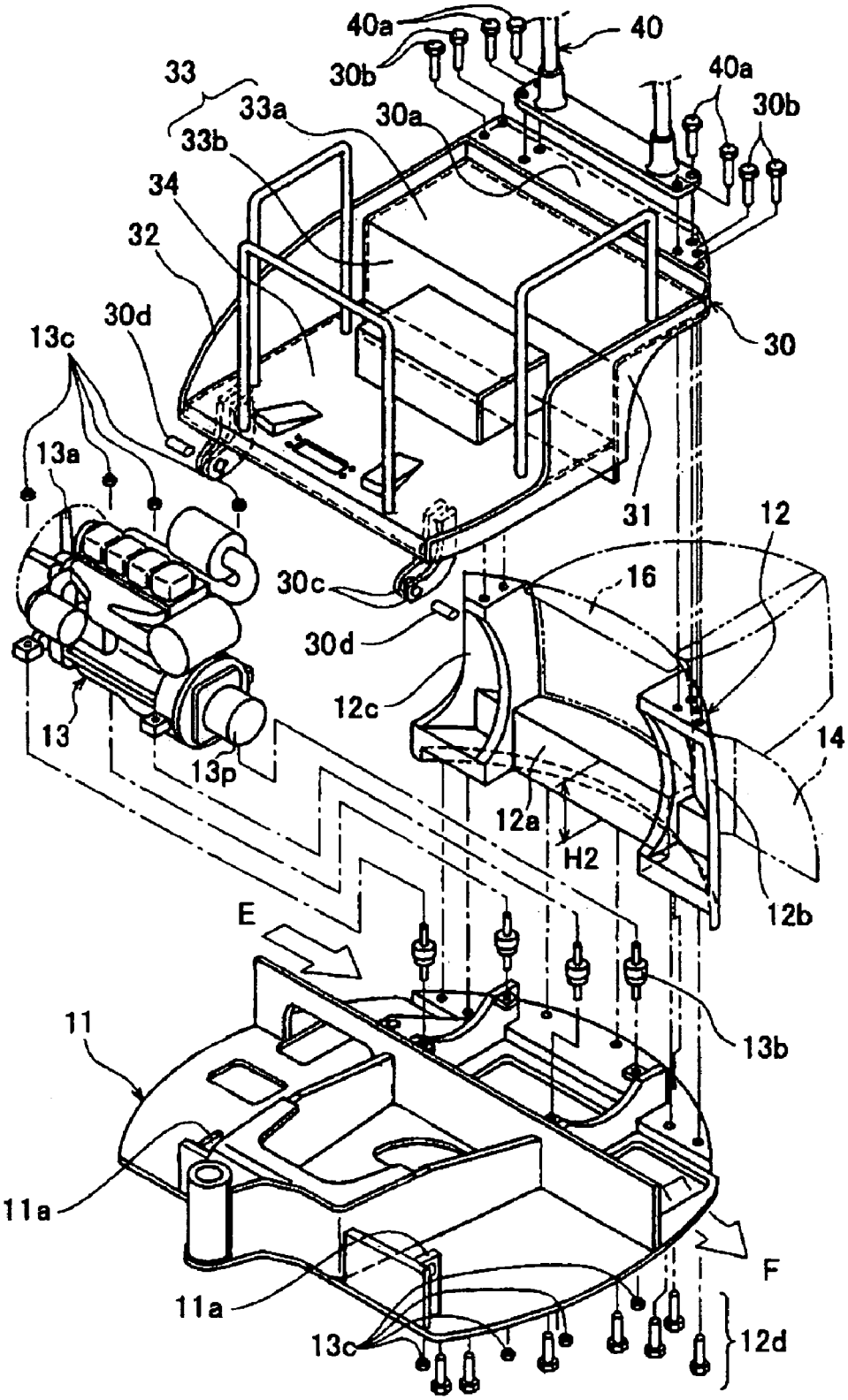
FIG. 3 is a development of the essential part of the hydraulic shovel in FIG. 1.

A preferred embodiment of a counterweight of a hydraulic shovel according to the present invention will be explained in detail with reference to FIG. 1 to FIG. 4 with a compact rear end small revolving hydraulic shovel as an example. First, in FIG. 1 to FIG. 3, a rear end small revolving hydraulic shovel 1 is loaded with an upper revolving superstructure 10 having a constitution, in which a locus of a revolving radius R of a rear end portion is within a lateral external width B of a base carrier 3, on a top portion of the base carrier 3 to be rotatable.

The upper revolving superstructure 10 has a counterweight 12 fastened to a rear end portion of a revolving frame 11, which is included at a bottom portion, with a predetermined number of bolts 12*d*. The counterweight 12 is constituted of a central base portion 12*a*, and supporting column portions 12*b* and 12*c* vertically provided at the left and right of the base portion 12*a* to be protruded upward in a horn shape. By making the mass of the supporting column portions 12*b* and 12*c* an increase amount of the mass of the counterweight 12, a height dimension H2 of the central base portion 12*a* is restrained to be small. In front of the counterweight 12, an engine 13 is placed laterally (namely, directed in the left-and-right direction of the vehicle body) at a position being faced from between the left and right supporting column portions 12*b* and 12*c*, and the engine 13 is mounted on the revolving frame 11 with a required number of vibration-proof rubbers 13*b* and nuts 13*c*.

A floor frame 30 is placed to cover a top surface and a front surface side of the engine 13. A flange portion 30*a* at a rear end portion of the floor frame 30 is supported at the left and right supporting column portions 12*b* and 12*c*, and fastened to the left and right supporting column portions 12*b* and 12*c* with bolts 30*b*. Brackets 30*c* and 30*c* are attached to a left and a right lower portions at a front side of the floor frame 30. The brackets 30*c* and 30*c* are rotatably connected to brackets 11*a* and 11*a* provided at a front portion of the revolving frame 11 with pins 30*d* and 30*d*. These things make it possible to tilt up the floor frame 30 to the front with the pins 30*d* and 30*d* as the support points by removing the bolts 30*b*.

The floor frame 30 is integrally constituted of a left and right side plates 31 and 32, and floor plates 33 and 34 for connecting the side plates 31 and 32. The floor plates 33 and 34 are integrally constituted in a stepped shape in the side view (refer to FIG. 1), a rear portion 33*a* thereof constitutes a top surface partition wall 33*a* of the engine 13, a central portion 33*b* thereof constitutes a front surface partition wall 33*b* of the engine 13, and a front portion 34 thereof constitutes a cab seat floor plate 34. A rear surface outer casing 16 and a left side surface outer casing 14 are attached to the supporting column portions 12*b* and 12*c* respectively to be openable and closable in the horizontal direction (details will be explained in FIG. 4). The rear surface outer casing 16 and the left side surface outer casing 14 respectively constitute the rear surface partition wall and the left surface partition wall of the engine 13.

According to the above constitution, a passage for guiding cooling air generating from a fan 13*a* of the engine 13 is formed by the rear portion (top surface partition wall) 33*a* of the floor frame 30, the central portion (front surface partition wall) 33*b*, the counterweight 12 (12*a*, 12*b* and 12*c*), and the rear surface outer casing 16. An operator seat 21 and an operating lever 22 are placed on the floor frame 30, and a cab seat 20 is constituted by them. A canopy 40 is fastened to a top surface of the rear end flange portion 30*a* of the floor frame 30 supported by the left and right supporting column portions 12*b* and 12*c* of the counterweight 12 with a predetermined number of bolts 40*a*. As a result of this, the canopy 40 is firmly supported at the left and right supporting column portions 12*b* and 12*c* of the counterweight 12.

Figure 4:
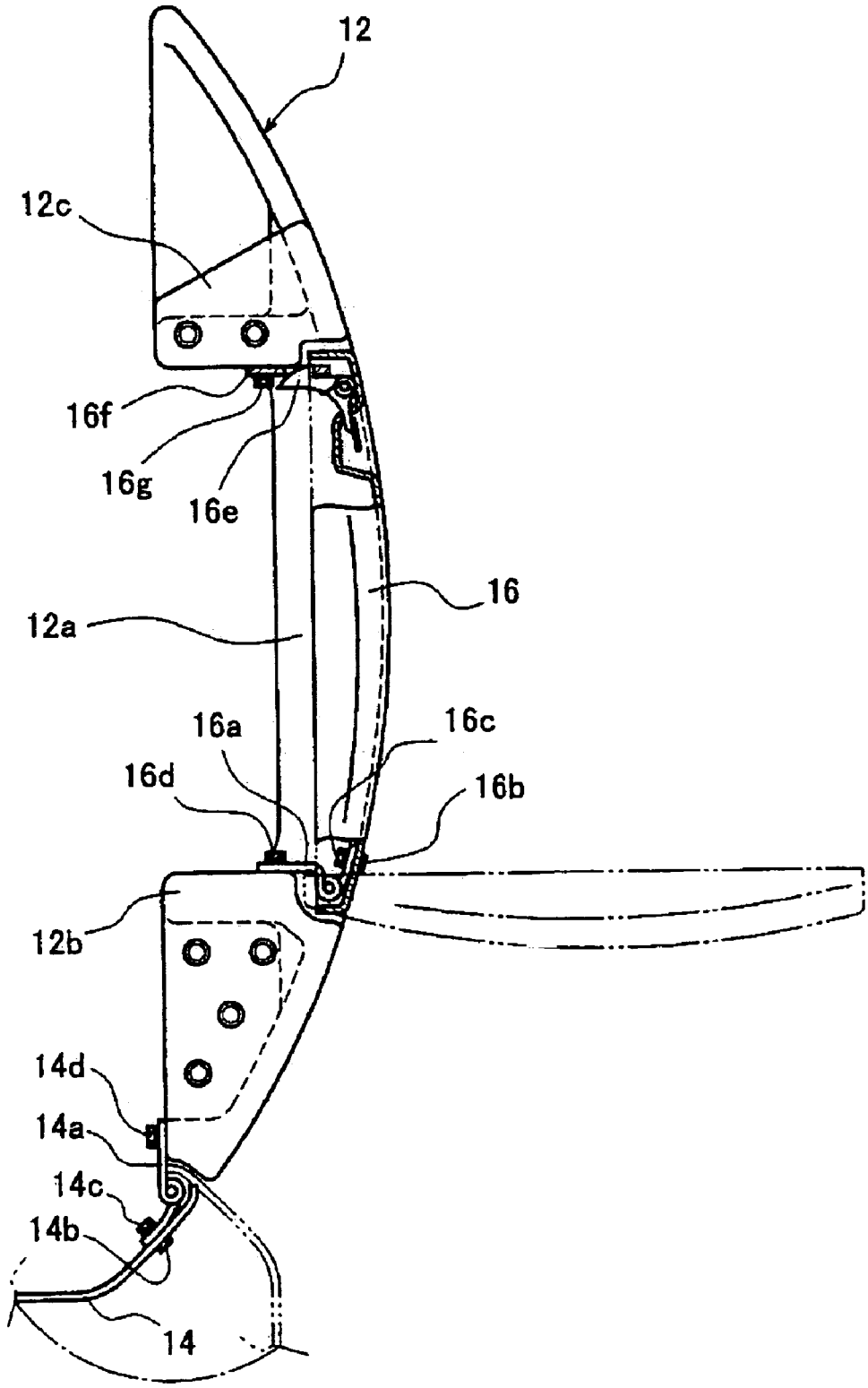
FIG. 4 is a view seen from the arrows 4 in FIG. 1, and is a top view of the cross section of the essential part of the counterweight.

Next, a mounting structure of the rear surface outer casing 16 and the left side surface outer casing 14 in the left and right supporting column portions 12*b* and 12*c* will be explained based on FIG. 4. One side members of a predetermined number of hinges 16*a* in an up-and-down direction are fastened to any one of the left and right supporting column portions (the left side supporting column portion 12*b* in FIG. 4) of the counterweight 12 with bolts 16*d*, and the other side members of the hinges 16*a* are attached to one side end portion of the rear surface outer casing 16 with bolts 16*b* and nuts 16*c*. A hook 16*f* engaging in a latch 16*e* attached to the other side of the rear surface outer casing 16 is fastened to the supporting column portion at the other side (the right side supporting column portion 12*c* in FIG. 4) with a bolt 16*g*. As a result of them, the outer casing 16 is simply attached to be openable and closable in the left and right direction without using the other frame members and the like. In addition, there is no decrease in opening area between both the supporting column portions 12*b* and 12*c* following the mounting of frames and the like, thus facilitating a maintenance operation of the engine 13 and the peripheral equipment of the engine.

One side members of a predetermined number of hinges 14*a* in the up and down direction (orthogonal direction to the paper surface) are fastened to a left side surface of the left supporting column portion 12*b* with bolts 14*d*, and the other side members of the hinges 14*a* are attached to a right side end portion of the left side surface outer casing 14 with bolts 14*b* and nuts 14*c*. As a result of this, the left side surface outer casing 14 is simply attached to be openable and closable in the horizontal direction without using the other frame members and the like. Further, there is no decrease in the opening area between the supporting column portion 12*b* and the left side plate 31 of the floor frame 30 following mounting of frames and the like, therefore facilitating a maintenance operation of a main pump 13*p* attached to the engine 13 and the other peripheral equipment of the engine.

The following effects can be obtained according to this embodiment.

Figure 5:
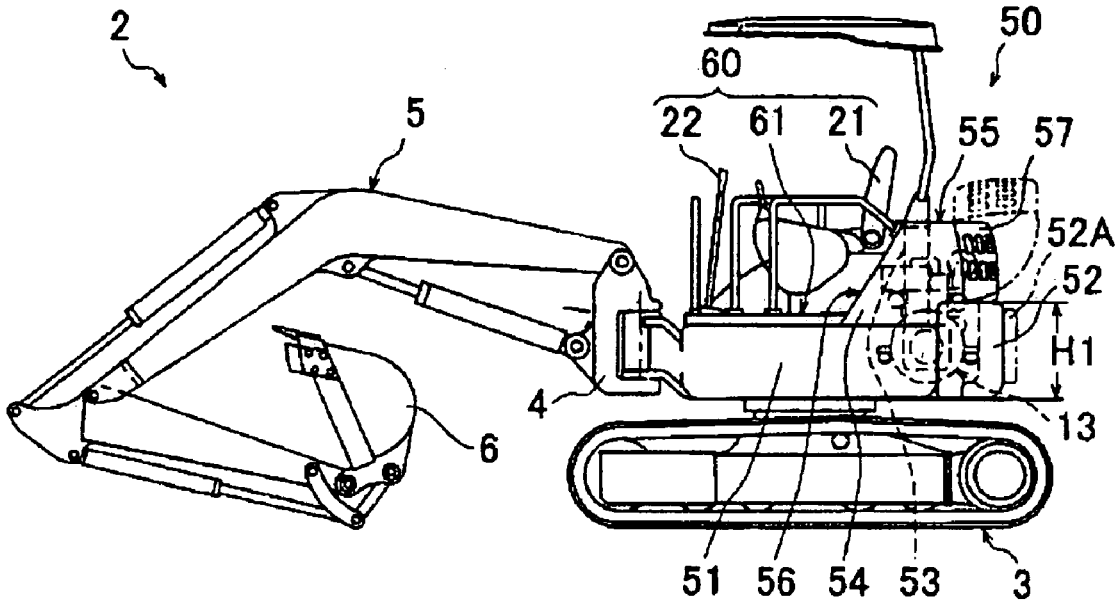
F I G. 5 Prior Art
FIG. 5 is a side view of a hydraulic shovel to which a counterweight according to a prior art is applied.
Figure 6:
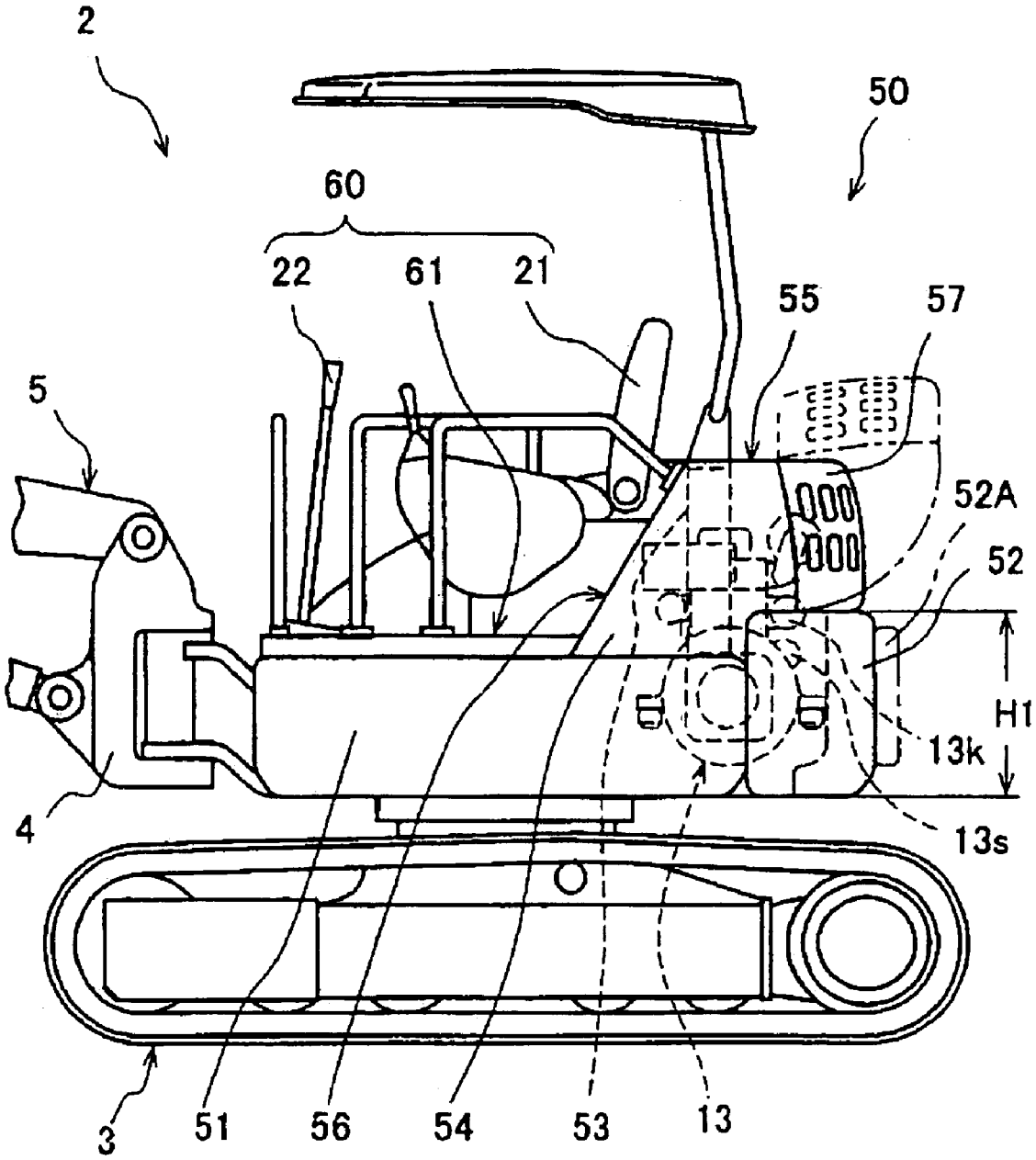
FIG. 6 Prior Art
FIG. 6 is a side view of an essential part of the hydraulic shovel in FIG. 5.
Figure 7:
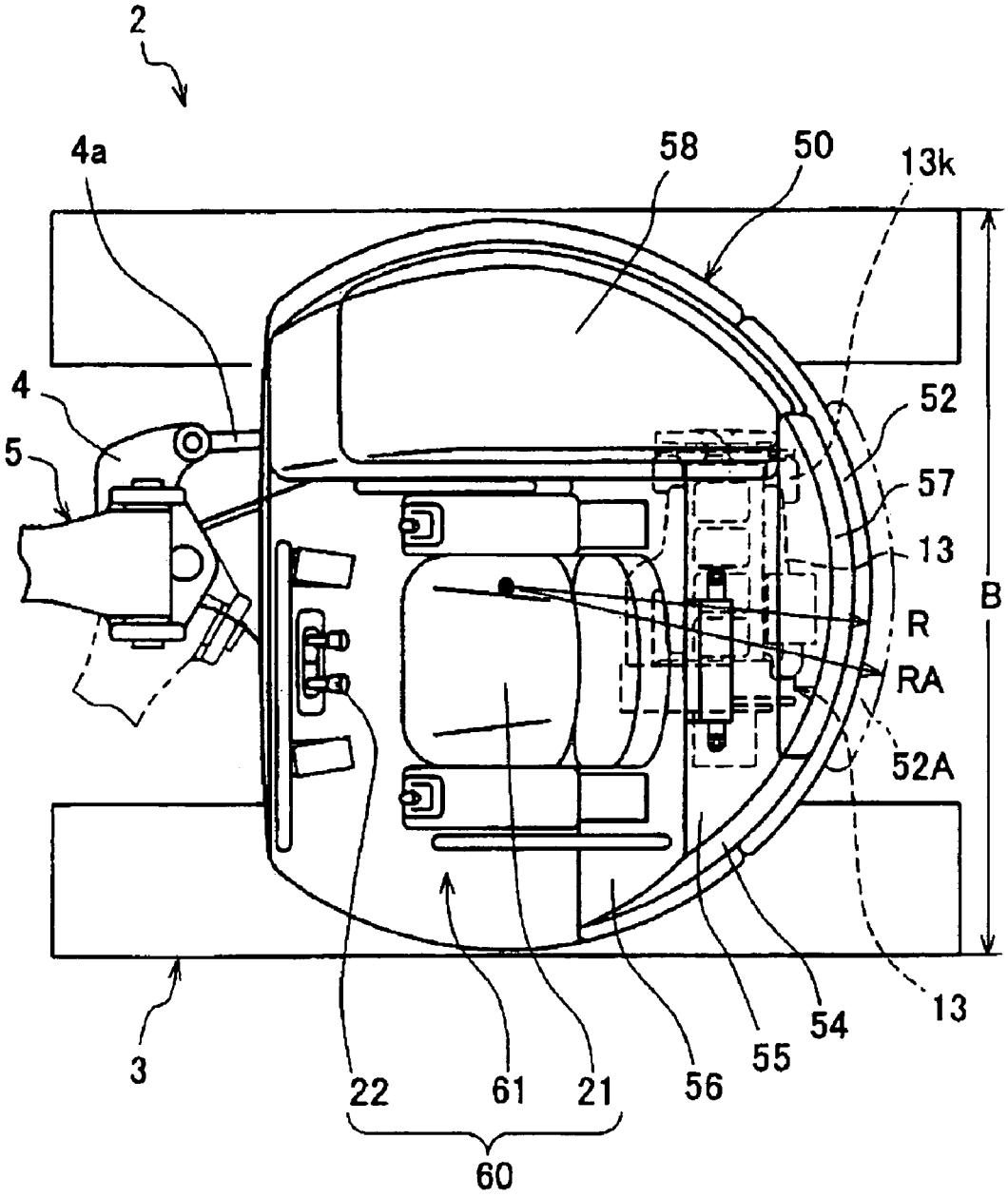
F I G. 7 Prior Art
FIG. 7 is a top view of the essential part of the hydraulic shovel in FIG. 5.

(1) It is made possible to utilize the counterweight, which is conventionally used only as a heavy load, as a structural component positively by vertically providing the supporting column portions 12*b* and 12*c* at the left and the right of the counterweight 12. Due to this, it is made easy to secure of the mass of the counterweight 12 by utilizing the space of the conventional structural component (the frame 53 shown in FIG. 5 and the like), and reduces the assembling man hours and the number of components by simplifying the structure of the upper revolving superstructure 10.

(2) Since the mass of the supporting column portions 12*b* and 12*c* are positively utilized as the increase amount of the counterweight mass, the height dimension H2 of the central base portion (main body) 12*a* of the counterweight 12 can be made small. This makes it possible to expose, for example, the starter 13*s* (See FIG. 1) of the engine 13 and the compressor 13*k* (See FIG. 1) at the time of being loaded with an air conditioner, and the like to above the top surface of the central base portion 12*a*, and as a result, maintainability of the engine 13 can be improved remarkably.

(3) Since the floor frame 30 is firmly supported by supporting the floor frame by the supporting column portions 12*b* and 12*c*, the other support members are not necessary, and it is made possible to mount the structural object such as the canopy, cabin or the like directly on, for example, the floor frame 30. Accordingly, there is no need to provide the other firm frames or the like for mounting them on the revolving frame 11, and therefore the degree of freedom of the placement space for the counterweight 12 becomes high, thus making it possible to secure the sufficient mass of the counterweight 12 easily. In addition, the upper revolving superstructure 10 has the extremely simple structure, and the assembling man hours and the number of components can be sharply reduced.

(4) Since the outer casings 14 and 16, the floor frame 30, the canopy 40 and the engine partition walls 33*a* and 33*b* are supported by the left and right supporting column portions 12*b* and 12*c*, the mounting structure around the counterweight 12 can be extremely simplified. As a result, the degree of freedom of the placement space for the counterweight 12 becomes high, which easily makes it possible to secure sufficient mass of the counterweight 12 and sharply reduces the number of components and man hours.

(5) Since the engine 13 is placed at the position fronting to between the left and right supporting column portions 12*b* and 12*c*, in front of the counterweight 12, the engine 13 can be maintained from between the supporting column portions 12*b* and 12*c* over the counterweight 12, and in combination with the above-described item (2), maintainability of the engine 13 can be improved remarkably.

(6) Each of the opening and closing support points (hinges 14*a* and 16*a* in the embodiment) of the side surface outer casing (the outer casing 14 at the left side surface in the embodiment) and the outer casing 16 of the rear surface is attached to at least any one of the left and right supporting column portions 12*b* and 12*c*, whereby the outer casings 14 and 16 can be simply attached to be openalbe and closable without using the other frame members and the like. In addition, there is no decrease in the opening area following mounting of the frame members and the like, a maintenance operation of the engine 13, the main pump 13*p* attached to the engine 13, and the other peripheral equipment can be facilitated.

In the above-described embodiment, the counterweight 12 is integrally constituted of the central base portion 12*a* the left and right supporting column portions 12*b* and 12*c*, but the constitution of the counterweight is not limited to this, and it may have the constitution capable of being divided and assembled at any optional position. The top surface partition wall 33*a* and the front surface partition wall 33*b* of the engine 13 are constituted integrally with the floor plate 34, but the constitution is not limited to this, and they may be detachable and attachable with bolts and the like.

Though the explanation is made with the small revolving hydraulic shovel cited as an example, but the application of the present invention is not limited to the compact rear end small revolving hydraulic shovel, and the present invention can be also carried out in the counterweights of the other hydraulic shovels as in the above description, and can provide the same effects as described above. Namely, the counterweight of the hydraulic shovel of the present invention is favorably applicable to the counterweights of a compact to large-sized hydraulic shovels, and is also capable of realizing favorable engine maintainability and assurance of sufficient mass.

What is claimed is:

1. A counterweight for a hydraulic shovel, comprising:

a central base portion; and supporting column portions extending vertically at left and right sides of the central base portion;

wherein the supporting column portions are taller than the central base portion; and wherein a floor frame of the hydraulic shovel is provided vertically over the supporting column portions, such that the supporting column portions support and are coupled to the floor frame.

2. The counterweight for the hydraulic shovel according to claim 1, further comprising at least one opening and closing support point of an outer casing of the hydraulic shovel provided on at least one of the supporting column portions.

3. The counterweight for the hydraulic shovel according to claim 2, wherein the opening and closing support point comprises a hinge.

4. The counterweight for the hydraulic shovel according to claim 1, wherein the supporting column portions further support at least one of a canopy, at least one outer casing of the hydraulic shovel and at least one engine partition wall of the hydraulic shovel.

5. The counterweight for the hydraulic shovel according to claim 4, further comprising at least one opening and closing support point of the at least one outer casing provided on at least one of the supporting column portions.

6. The counterweight for the hydraulic shovel according to claim 1, wherein an engine is placed at a position in front of and between the supporting column portions at the left and right of the central base portion.

7. The counterweight for the hydraulic shovel according to claim 6, further comprising at least one opening and closing support point of an outer casing of the hydraulic shovel provided on at least one of the supporting column portions.

* * * * *